US011156014B1

(12) United States Patent
He

(10) Patent No.: US 11,156,014 B1
(45) Date of Patent: Oct. 26, 2021

(54) OUTDOOR TENT

(71) Applicant: Taizhou Bolvda Arts & Crafts Co., Ltd., Linhai (CN)

(72) Inventor: Daqin He, Linhai (CN)

(73) Assignee: TAIZHOU BOLVDA ARTS & CRAFTS CO., LTD., Linhai (CN)

( * ) Notice: Subject to any disclaimer, the term of this patent is extended or adjusted under 35 U.S.C. 154(b) by 0 days.

(21) Appl. No.: 17/069,652

(22) Filed: Oct. 13, 2020

(30) Foreign Application Priority Data

Jul. 6, 2020 (CN) ..... 202010640376.4

(51) Int. Cl.

| | |
|---|---|
| ***E04H 15/58*** | (2006.01) |
| ***E04H 15/54*** | (2006.01) |
| ***E04F 10/06*** | (2006.01) |
| ***E04F 10/02*** | (2006.01) |
| ***E04H 15/46*** | (2006.01) |

(52) U.S. Cl.
CPC ..... *E04H 15/58* (2013.01); *E04F 10/02* (2013.01); *E04F 10/0607* (2013.01); *E04H 15/54* (2013.01); *E04H 15/46* (2013.01)

(58) Field of Classification Search
CPC ..... E04H 15/58; E04F 10/02; E04F 10/0607; E04F 10/0633
See application file for complete search history.

(56) References Cited

U.S. PATENT DOCUMENTS

| | | | | |
|---|---|---|---|---|
| 8,800,214 | B2 * | 8/2014 | Silberman | E04F 10/02 52/64 |
| 9,249,576 | B2 * | 2/2016 | Westgarth | E04F 10/02 |
| 9,255,441 | B2 * | 2/2016 | Shargani | E04F 10/02 |
| 9,470,012 | B2 * | 10/2016 | Shargani | E04F 10/0633 |
| 9,624,689 | B2 * | 4/2017 | Bailey | E04H 15/64 |
| 9,644,389 | B2 * | 5/2017 | Xie | E04F 10/02 |
| 9,745,755 | B2 * | 8/2017 | Shargani | E04F 10/02 |
| 9,938,723 | B2 * | 4/2018 | Shargani | E04F 10/02 |
| 10,494,817 | B2 * | 12/2019 | Bailey | E06B 9/581 |
| 10,815,689 | B2 * | 10/2020 | Ji | H02S 20/30 |
| 10,914,068 | B2 * | 2/2021 | Shargani | E04B 1/34357 |
| 2019/0112832 | A1 * | 4/2019 | Larin | E04H 15/42 |
| 2021/0153614 | A1 * | 5/2021 | Teblick | A45B 19/12 |

FOREIGN PATENT DOCUMENTS

| | | | | |
|---|---|---|---|---|
| CN | 206581689 | U | 10/2017 | |
| CN | 110107145 | A | 8/2019 | |
| EP | 2284330 | A1 * | 2/2011 | E04F 10/02 |
| EP | 3255221 | A1 * | 12/2017 | E04F 10/02 |
| EP | 3101197 | B1 * | 4/2019 | E04F 10/0681 |
| EP | 3255221 | B1 * | 7/2019 | E04F 10/02 |
| EP | 3309319 | B1 * | 1/2020 | E04F 10/02 |
| JP | 5500613 | B2 * | 5/2014 | E04F 10/02 |
| WO | WO-2014170510 | A1 * | 10/2014 | E04H 15/36 |
| WO | WO-2020240605 | A1 * | 12/2020 | E04F 10/02 |

* cited by examiner

*Primary Examiner* — David R Dunn
*Assistant Examiner* — Danielle Jackson
(74) *Attorney, Agent, or Firm* — Loza & Loza, LLP; Michael F. Fedrick

(57) ABSTRACT

An outdoor tent which includes a tent roof and a tent body. The tent roof includes a tent canopy, a telescopic assembly and a driving component. The tent canopy is used to cooperate with the telescopic assembly, and the telescopic assembly can realize extension or folding through the driving component, so that the tent canopy can be extended or folded.

10 Claims, 20 Drawing Sheets

OUTDOOR TENT

CROSS-REFERENCE TO RELATED APPLICATIONS

This application claims the benefit of priority under 35 U.S.C. § 120 from Chinese Patent Application No. 202010640376.4, filed Jul. 6, 2020, the disclosure of which is incorporated herein by reference in its entirety.

INTRODUCTION/BACKGROUND

Outdoor tents, also known as awnings, are modern outdoor furniture products that have the functions of blocking sunlight, ultraviolet radiation, and wind and rain. They are widely used in people's daily life. Due to different roof structures, outdoor tents can be divided into louver tents, hard top tents, iron tents or tarpaulin (canopy) tents. Tarpaulin tents are popular because of their low cost and convenient assembly. However, the roof structure of a traditional tarpaulin tent is fixed and cannot be folded and contracted, and therefore has limitations in use.

For example, Chinese Patent Publication No. CN110107145A discloses an outdoor awning with a retractable electric track. This structure includes a first guide rail and a second guide rail, a driving mechanism, a sunshade cloth and a sunshade cloth head fixing member. However, the structure of the driving mechanism in this structure is relatively complicated, which results in a relatively complicated assembly and high manufacturing cost. In addition, after the tarpaulin is folded and retracted, the tarpaulin hangs upside down on the roof. This causes interference for users at the bottom of the tent, affects the overall aesthetics, and can even easily touch standing people, making the product experience extremely poor.

SUMMARY

The present invention relates to an outdoor tent having a body and a retractable top. The body has a generally rectangular ring beam frame comprising at least a distal transverse ring beam, a right side longitudinal ring beam, a left side longitudinal ring beam. In one embodiment, the body can have two legs and be attached at an open end to a structure such as the wall of a building. Preferably the frame also a proximal transverse ring beam so as to form a rectangular structure to allow the tent to be free standing, in which case the right side of the proximal transverse ring beam is attached to a proximal end of the right side longitudinal ring beam and the left side of the proximal transverse ring beam is attached to a proximal end of the left side longitudinal ring beam. In this embodiment the tent has at least 3 legs, preferably 4 legs extending downwardly from each corner of the rectangular ring beam frame. Also included are a right side track and a left side track, where the right side track is secured to the right side longitudinal ring beam and the left side track is secured to the left side longitudinal ring beam.

The tent top includes a canopy and a telescopic assembly beneath the canopy. The telescopic assembly includes a right side telescopic component and a left side telescopic component which each generally comprise a plurality of folding units and a plurality of wheel seats. Each folding unit includes a hinge seat, a proximal hinge shaft, and a distal hinge shaft, with the hinge seat being hingedly connected on a proximal side to the proximal hinge shaft and on a distal side to the distal hinge shaft. Each wheel seat includes at least one hinge groove hingedly connected to the proximal hinge shaft or the distal hinge shaft of a folding unit. The plurality of wheel seats includes a fixed end wheel seat on a proximal end of the track which remains fixed in place and is hingedly connected to a proximal hinge shaft of an adjacent folding unit. It also includes a movable end wheel seat on a distal end of the track which is hingedly connected to a distal hinge shaft of an adjacent folding unit, with a plurality of linkage movable wheel seats between the fixed end wheel seat and the movable end wheel seat. Each linkage movable wheel seat is hingedly connected on a proximal end to the distal hinge shaft of a proximally positioned adjacent folding unit and is hingedly connected on a distal end to the proximal hinge shaft of a distally positioned adjacent folding unit. The telescopic assembly further comprises a plurality of canopy poles which are mechanically connected on each end to a respective hinge seat of a folding unit on the left or right side of the frame. A connecting rod is secured to and extends between the right side movable end wheel seat and the left side movable end wheel seat.

The present tent further includes a driving component which has a drive belt extending longitudinally on an interior of at least one of the right side track or the left side track. A drive assembly is used to move the drive belt, and a sliding seat operably connects the drive belt to the movable end wheel seat. The drive assembly is operable to rotate the drive belt, which moves the sliding seat, and movement of the sliding seat operates to move the telescopic assembly and canopy, thereby extending or retracting the canopy along the longitudinal ring beams. In one embodiment, the sliding seat is fixedly secured to each of the movable end wheel seats. Alternatively, the sliding seat can be mechanically connected to the connecting rod. The driving component can be manually driven, or the drive assembly can comprise a drive motor. The drive motor can rotate a driving gear which rotates the drive belt, and some embodiments a drive worm can be used to rotate a transmission gear which rotates the driving gear.

Figure 1:
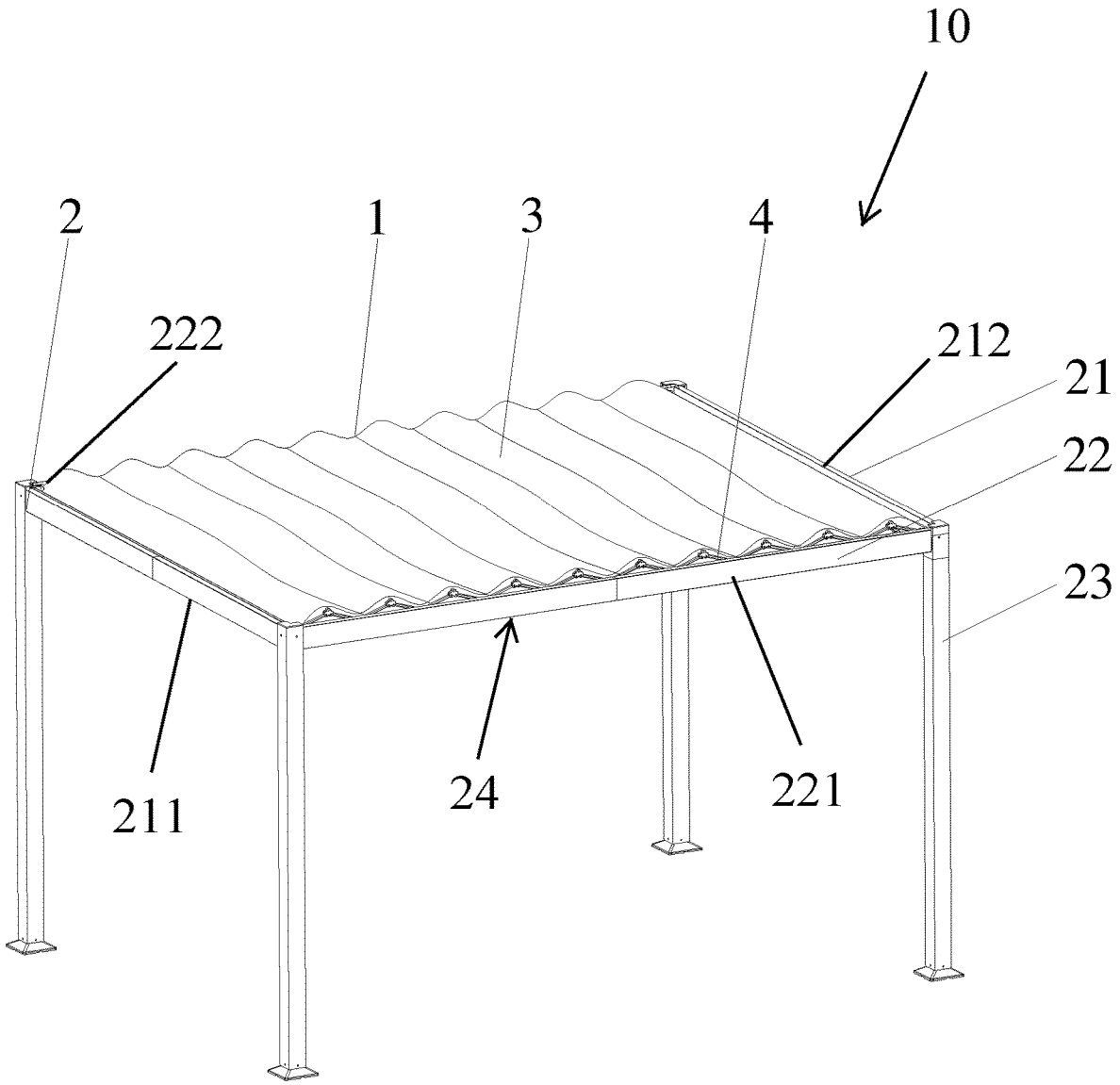
FIG. 1 is a right side perspective view of a tent of the present invention with the canopy extended.
Figure 2:
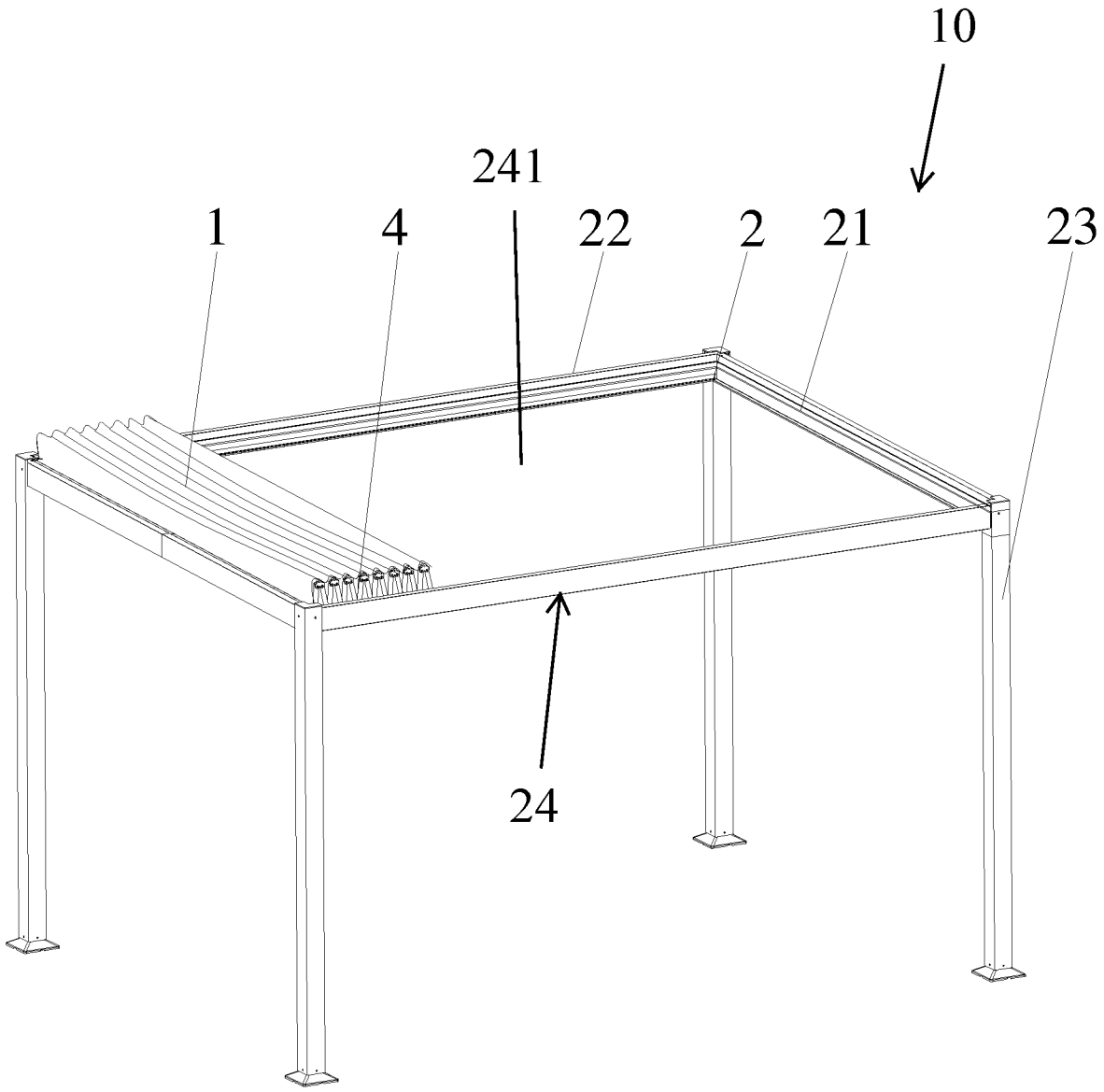
FIG. 2 is a right side perspective view of the tent of FIG. 1 with the canopy retracted.
Figure 3:
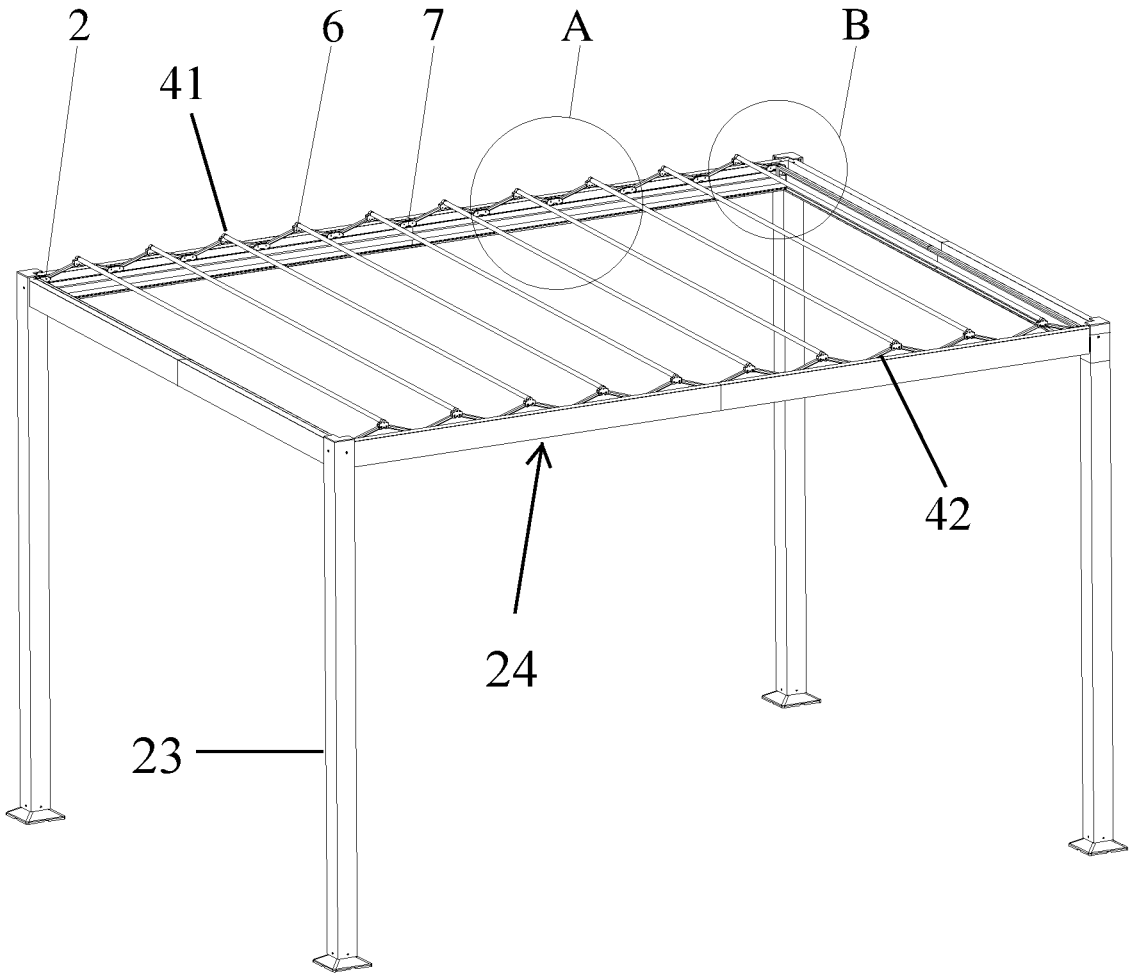
FIG. 3 is a right side perspective view of the structural components of the tent of FIG. 1, without the canopy.
Figure 4:
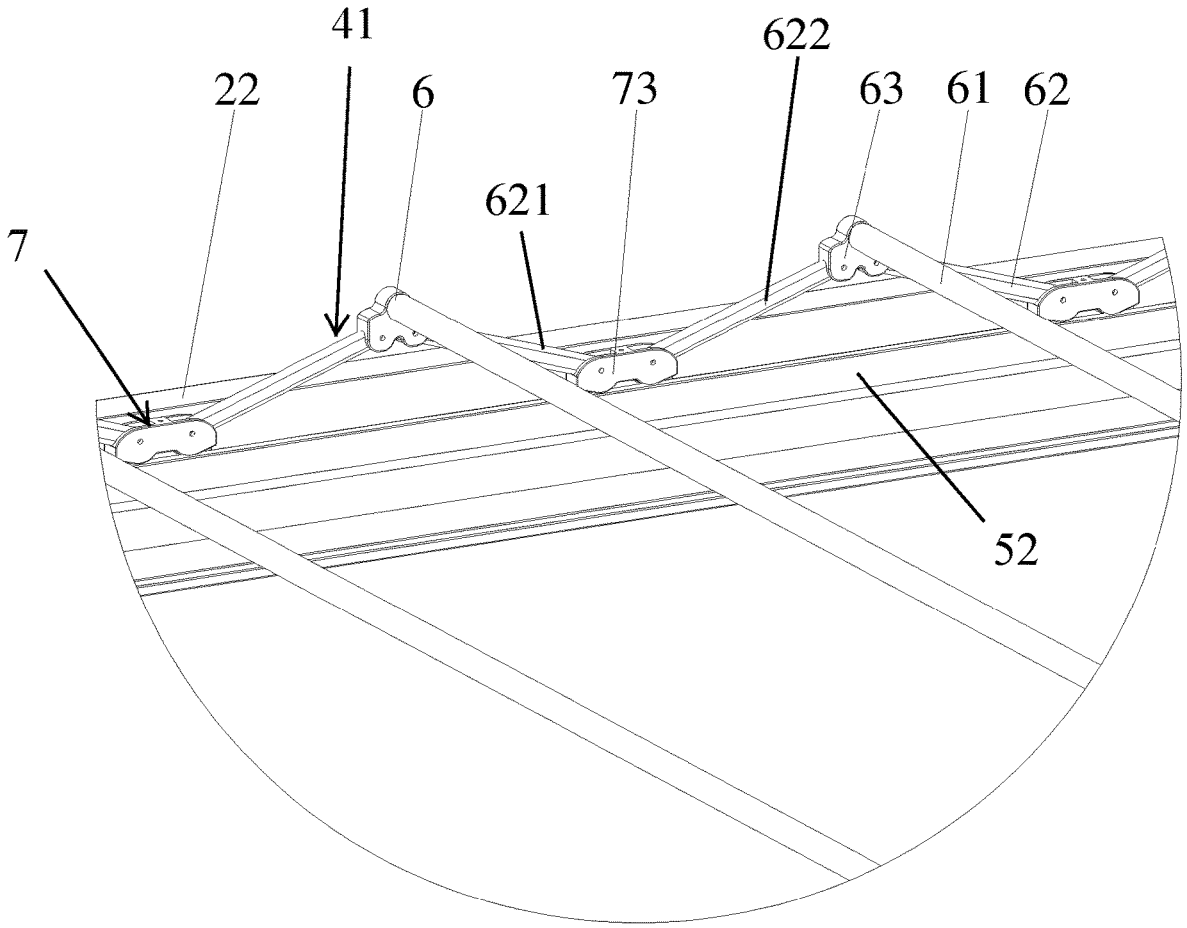
FIG. 4 is a close-up perspective view of the area designated with an "A" in FIG. 3.

The reference numbers in the figures have the following meanings:

| Component | Reference Number |
|---|---|
| 1 | tent roof (canopy) |
| 2 | tent body |
| 21 | transverse ring beam |
| 211 | proximal transverse ring beam |
| 212 | distal transverse ring beam |
| 22 | longitudinal ring beam |
| 221 | right longitudinal ring beam |
| 222 | left longitudinal ring beam |
| 23 | leg |
| 24 | ring beam frame |
| 241 | interior of ring beam frame |
| 25 | proximal end |
| 27 | distal end |
| 3 | tarpaulin |
| 4 | telescopic assembly |
| 41 | right side telescopic component |
| 42 | left side telescopic component |
| 5 | driving component |
| 51 | driving assembly |
| 511 | driving motor |
| 512 | driving gear |
| 513 | transmission worm |
| 514 | transmission gear |
| 5141 | first transmission gear |
| 5142 | second driving gear |
| 5143 | connecting shaft |
| 515 | transmission coupling shaft |
| 516 | shaft sleeve |
| 52 | track |
| 521 | downwardly extending flange |
| 522 | upwardly extending flange |
| 523 | U-shaped beam |
| 524 | track interior |
| 525 | sliding groove |
| 53 | sliding seat |
| 531 | flange |
| 532 | wheel |
| 54 | transmission belt |
| 6 | folding unit |

-continued

| Component | Reference Number |
|---|---|
| 61 | canopy pole |
| 62 | hinge shaft |
| 621 | proximal hinge shaft |
| 622 | distal hinge shaft |
| 63 | hinge seat |
| 631 | distal hinge groove |
| 64 | mobile connecting rod |
| 65 | fixed end connecting rod |
| 7 | mobile wheel seat |
| 71 | movable end mobile wheel seat |
| 711 | installation groove |
| 712 | interior face |
| 72 | fixed end wheel seat |
| 721 | installation groove |
| 722 | interior face |
| 73 | linkage movable wheel seat |
| 74 | wheel seat body |
| 75 | lower hinge groove |
| 751 | proximal lower hinge groove |
| 752 | distal lower hinge groove |
| 76 | moving roller |
| 10 | tent |

DETAILED DESCRIPTION

Definitions

As used herein, the following terms and variations thereof have the meanings given below, unless a different meaning is clearly intended by the context in which such term is used.

"Beams" refer to elongated rigid or semi-rigid structural components of the present tent.

"Canopy" refers to a panel of flexible material suspended by or over a structure as a cover. The term "tarpaulin" is used to describe canopies that can be used with the present tent.

"Horizontal" refers to an orientation approximately parallel to (i.e., not substantially extending toward or away from) the ground or other support surface on which the present tent is or can be positioned.

"Legs" refer to rigid supports for supporting the canopy and framework of the tent above the ground or other support surface on which the present tent is or can be positioned.

"Lower," "downward" and "downwardly" mean in the direction of or toward the ground or other support surface on which the present tent is or can be positioned.

"Panel" refers to a section or piece of material extending over or covering a predetermined area. Panels are generally flat, i.e. are relatively thin as compared to the extent of their length or width and can be curved or planar. Materials used to form the panels used in the present invention are flexible, such as fabric.

"Rectangle" and "rectangular" refer to a quadrilateral parallelogram in which both pairs of opposite sides are parallel to each other, whose sides preferably meet to form four right angles. A square is a rectangle having all four sides of equal length.

"Ring beam" refers to beams arranged in a generally horizontal manner such that their ends interlock with other beams.

"Tent" refers to a portable shelter comprising a framework covered by a panel of material.

"Upper," "upward," and "upwardly" refer to the relative position of a component in the present drink tray which is further from or away from the ground or other support surface on which the present tent is or can be positioned.

"Vertical" refers to an orientation extending toward or away from a support surface on which the present tent is or can be positioned.

The terms "above," "below," "interior," "exterior," "top", "bottom," "proximal," "distal," "right," "left," "between," and other terms of relative position or orientation as used herein refer to a relative position of one component of the present structure with respect to other components.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise. Ranges which are described as being "between" two values include the indicated values.

DETAILED DESCRIPTION OF THE INVENTION

As shown in the attached drawings, an outdoor tent 10 provided by the illustrated embodiment comprises a tent top 1 and a tent body 2. The tent top 1 includes a tent canopy 3, a telescopic assembly 4 and a driving component 5. Tent canopy 3 is used for installation with the telescopic assembly 4. The driving component 5 extends or retracts the telescopic assembly 4, thereby extending or folding the tent canopy 3.

Preferably, the tent body 2 includes at least two legs 23 extending downwardly from a generally rectangular frame, which is preferably a horizontal ring beam frame 24. The ring beam frame 24 includes one or two transverse ring beams 21, such proximal transverse ring beam 211 and distal transverse ring beam 212, and longitudinal ring beams 22, namely right side longitudinal ring beam 221 and left side longitudinal ring beam 222. The telescopic assembly 4 cooperates with the longitudinal ring beams 22 to extend and retract the canopy 3. The telescopic assembly 4 can be stretched or folded along the longitudinal direction of the longitudinal ring beams 22. In one of the embodiments, the tent body 2 includes two legs 23 and a ring beam frame 24, in which case one side of the ring beam frame 24 is preferably secured to another structure, such as the wall of a building. The ring beam frame includes one or two transverse ring beams 21 and two longitudinal ring beams 22. In one of the embodiments, the tent body 2 includes four legs 23 and a rectangular ring beam frame 24, and is a common outdoor tent with a four-leg structure. In another embodiment, the tent body 2 includes two ring beam frames attached to each other on one side, such as by attaching two transverse ring beams 21, and forms a two-top structure. In this embodiment, the tent 10 can have four legs 23, one on each corner of the rectangular frame structure, thereby forming a two-top four-leg structure. Alternatively, in this embodiment the tent can have two additional legs positioned centrally on the rectangular frame (i.e., not on the corners) in order to form a two-top, six-leg structure. In another alternative, one side of a two-top tent can be attached to a wall and can include only two corner legs and two additional legs positioned centrally on the rectangular frame. The tent body 2 in the present invention can thus have multiple combinations.

Figure 16:
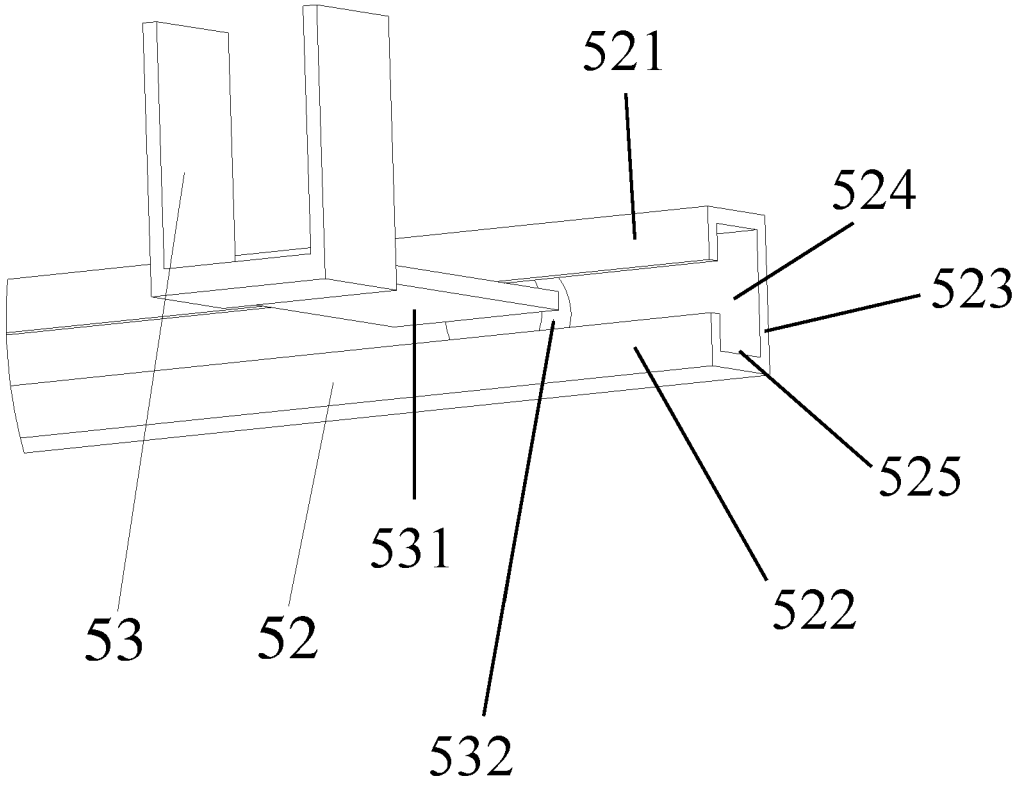
FIG. 16 is a perspective view of the interior face of a track and sliding seat of the driving component.
Figure 17:
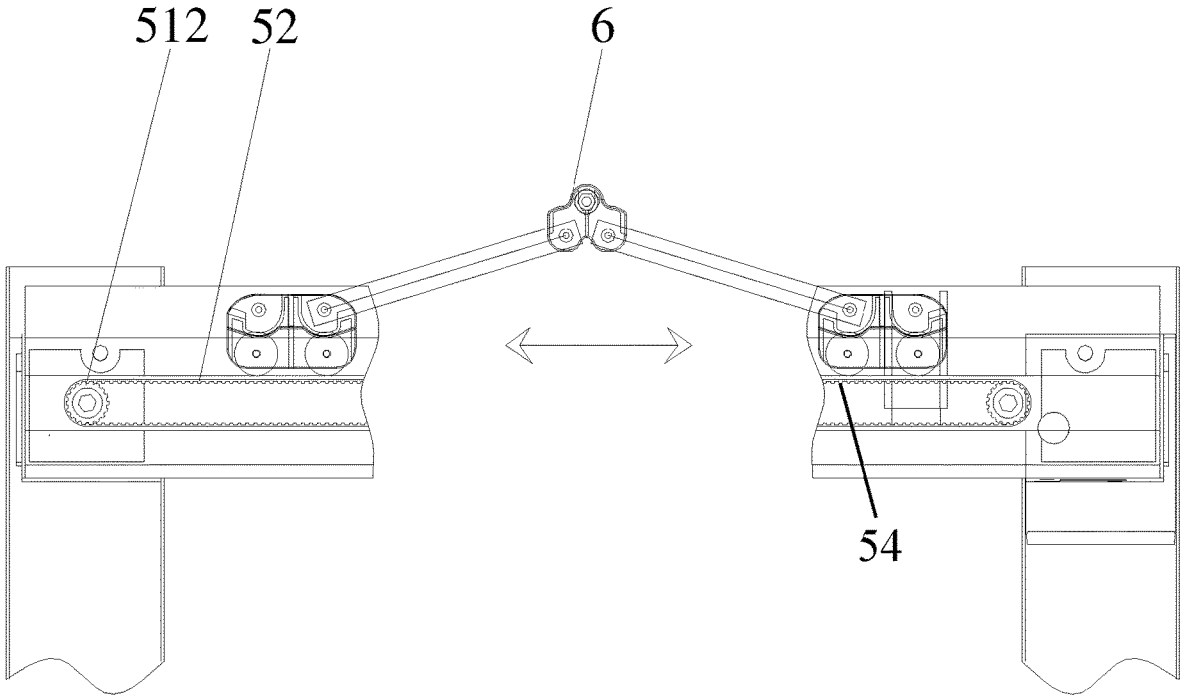
FIG. 17 is a sectional elevation view of the track and gears of the driving component of the present tent together with the folding unit.
Figure 18:
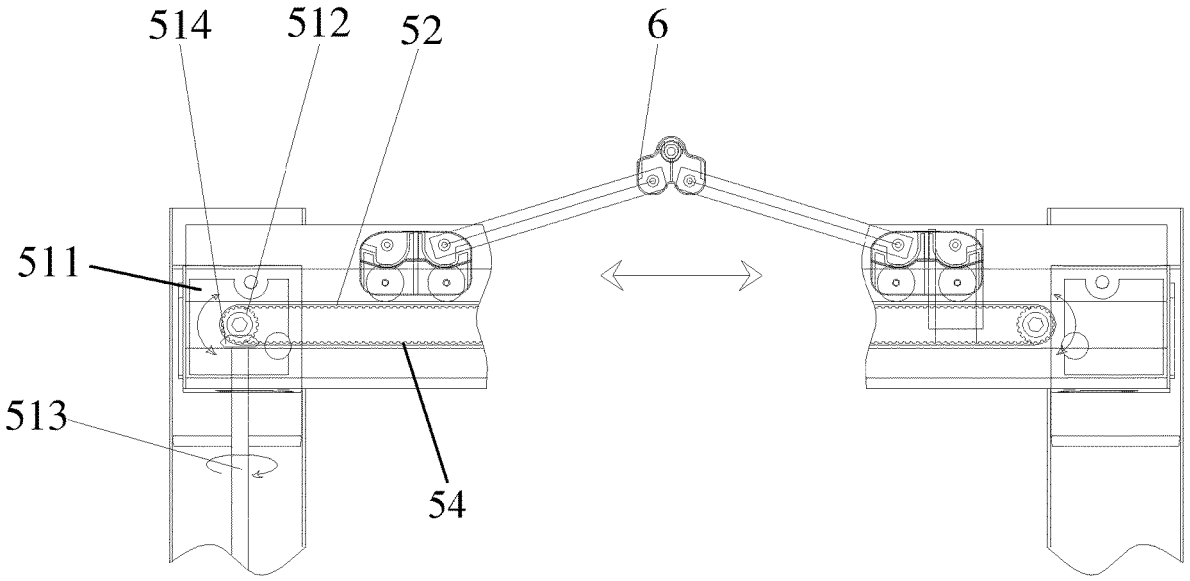
FIG. 18 is a sectional elevation view of the driving component and folding unit of FIG. 17, further showing a transmission worm and transmission gear of a worm drive.
Figure 19:
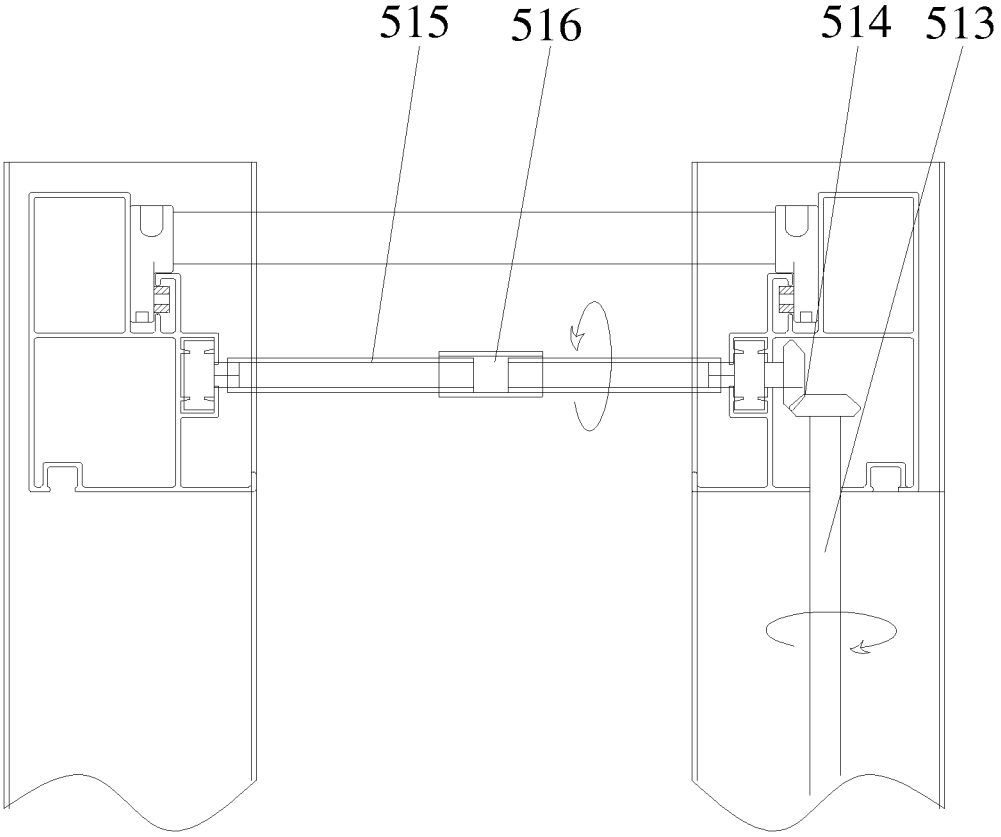
FIG. 19 is a sectional elevation view of the worm drive of FIG. 18 coupled with a transmission coupling shaft.
Figure 20:
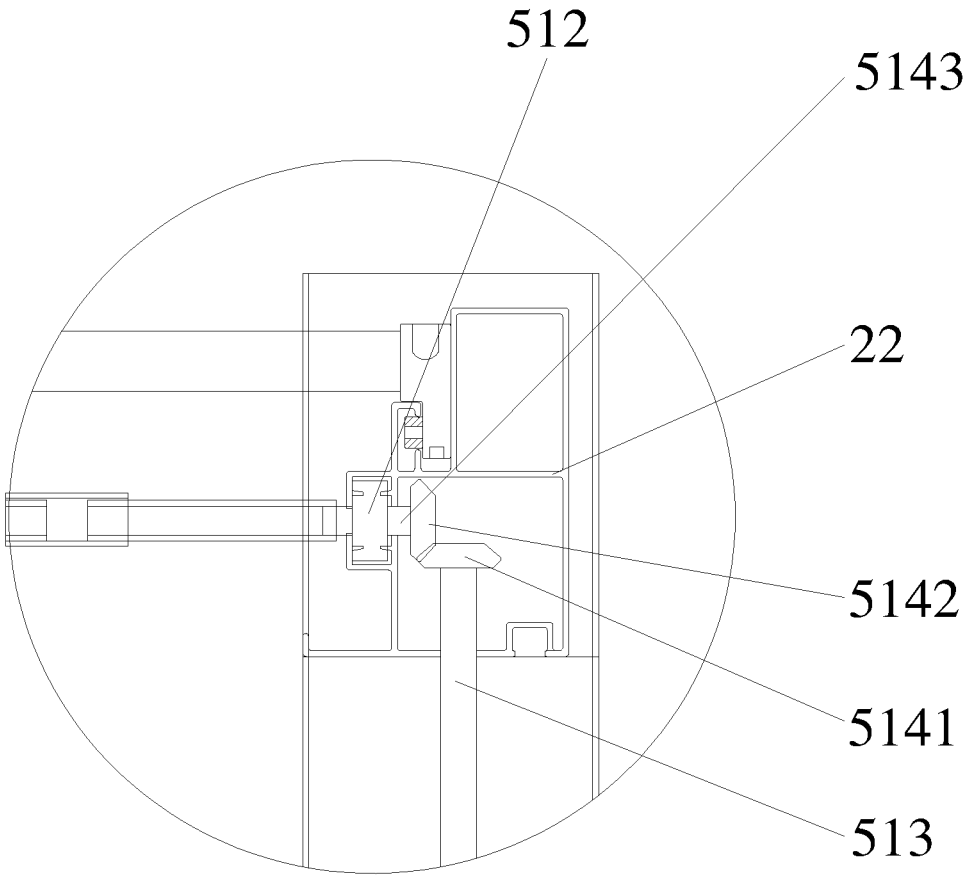
FIG. 20 is a close-up sectional elevation view of the transmission and driving gears shown on the right side in FIG. 19.

Preferably, a track 52 having a sliding groove 525 is provided in or on the longitudinal ring beam 22, preferably on an interior portion of the frame 24, and the sliding groove 525 is arranged along the length of the longitudinal ring beam 22. As illustrated in FIG. 16, the sliding groove 525 preferably comprises a U-shaped beam 523 having a downwardly extending flange 521 and an upwardly extending flange 522 which partially surrounds an interior 524 of the track 52. The sliding groove 525 is used to cooperate with the movable wheel seat 7 to slide, and the sliding groove 525 is usually a groove structure to facilitate the movement of the wheel seat. Preferably, the track 52 is installed on the longitudinal ring beam 22. A sliding seat 53 is operably connected to a drive belt 54 by a flange 531 which is operably connected to a wheel 532 situated on the interior 524 of the track 52. The wheel 532 can be a cogwheel, for example, which has teeth that mesh with interior ridges of a drive belt (shown in FIGS. 17 and 18).

Preferably, the telescopic assembly 4 includes several folding units 6 and movable wheel seats 7 arranged sequentially. When a number of moving wheel seats 7 are sequentially retracted into a closed position, a number of folding units 6 are sequentially folded. The two ends of the telescopic assembly 4 are respectively a fixed end and a movable end, and the movable end can move closer to or further away from the fixed end. The plurality of movable wheel seats 7 includes a fixed end wheel seat 72, a movable end wheel seat 71, and a linkage movable wheel seat 73 between the fixed end wheel seat 72 and the movable end wheel seat 71. Two adjacent folding units 6 are installed in cooperation through a linkage movable wheel seat 73. The fixed end is usually located on one side of the ring beam frame, generally the proximal end of the longitudinal ring beam 22. The movable end can move along the longitudinal ring beam 22 to the distal end. When in a fully extended state, the movable end wheel seat 71 is usually located at or near the distal end of the longitudinal ring beam 22.

Figure 5:
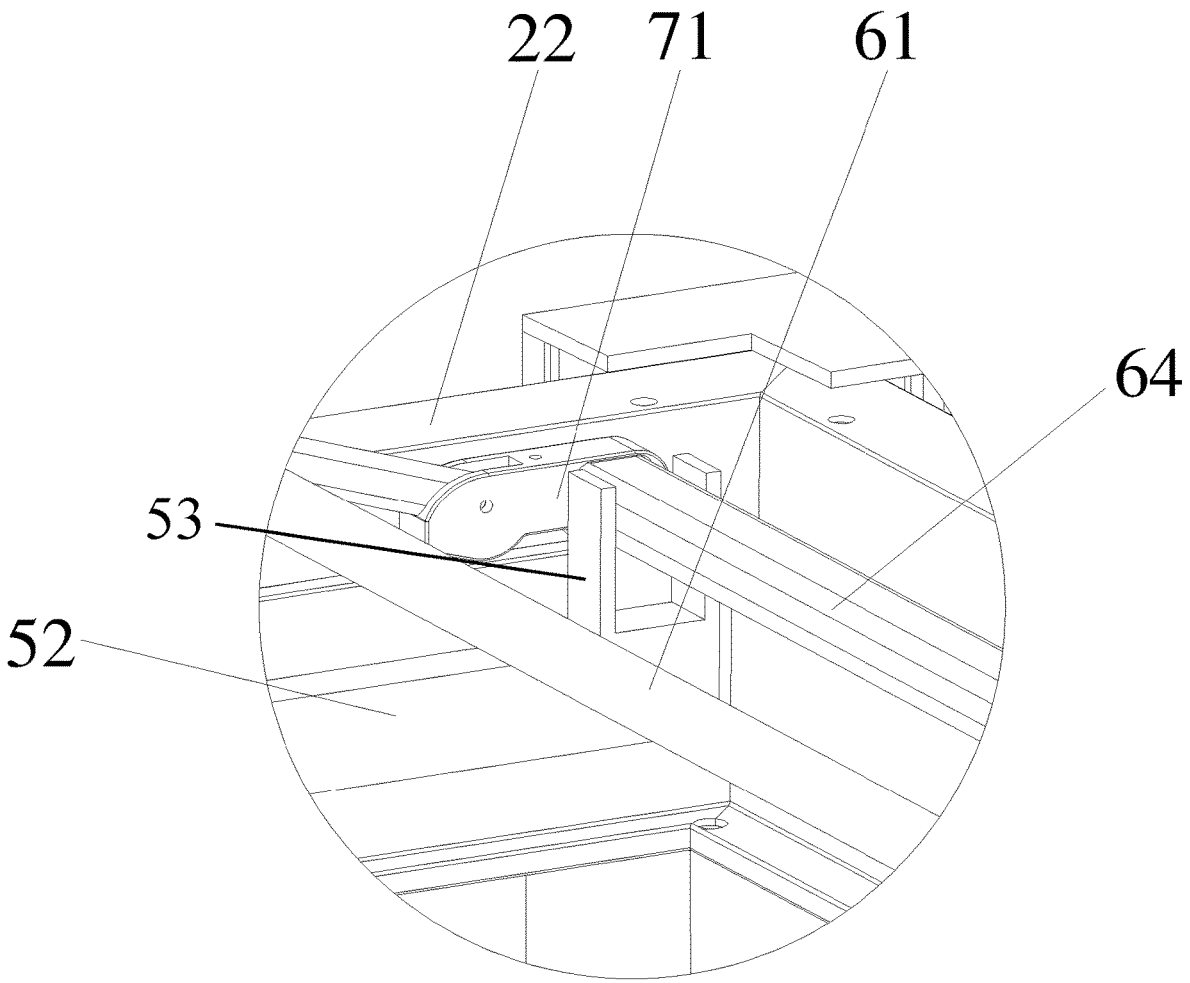
FIG. 5 is a close-up perspective view of the area designated with an "B" in FIG. 3.
Figure 6:
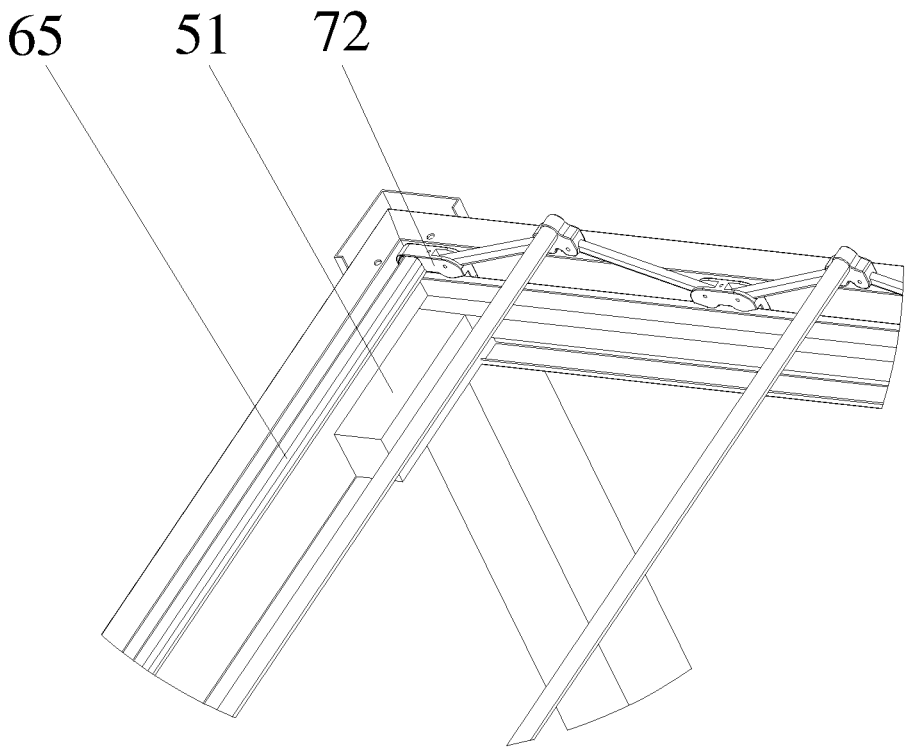
FIG. 6 is an upper perspective view of a corner of the tent structure shown in FIG. 3.
Figure 7:
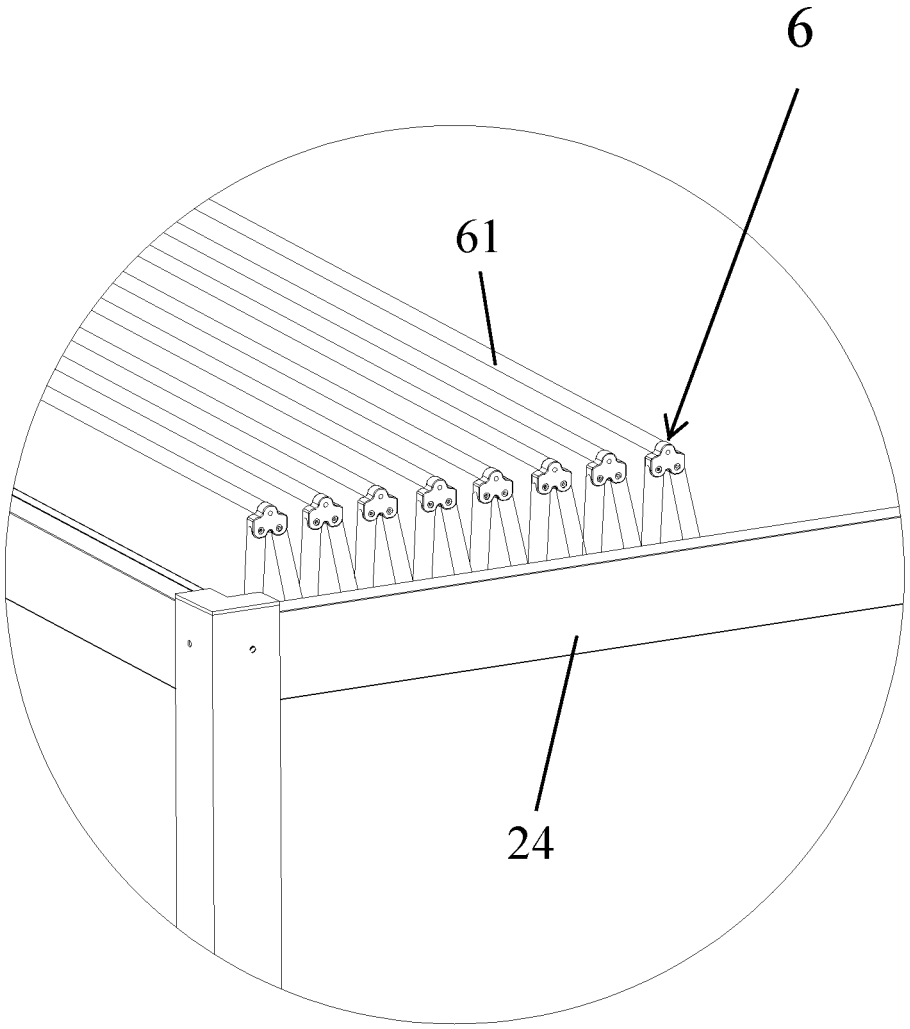
FIG. 7 is a right side perspective view of the right side proximal corner of the tent structure shown in FIG. 2.
Figure 8:
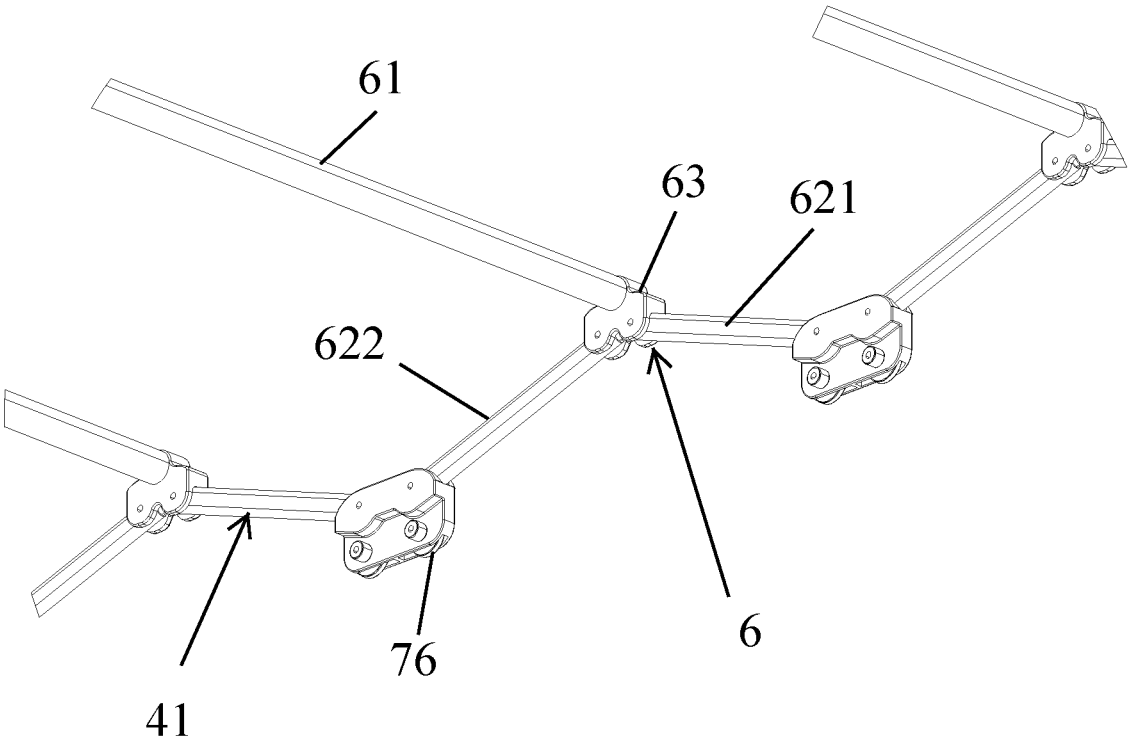
FIG. 8 is a lower perspective view of a folding unit used with the present tent.
Figure 9:
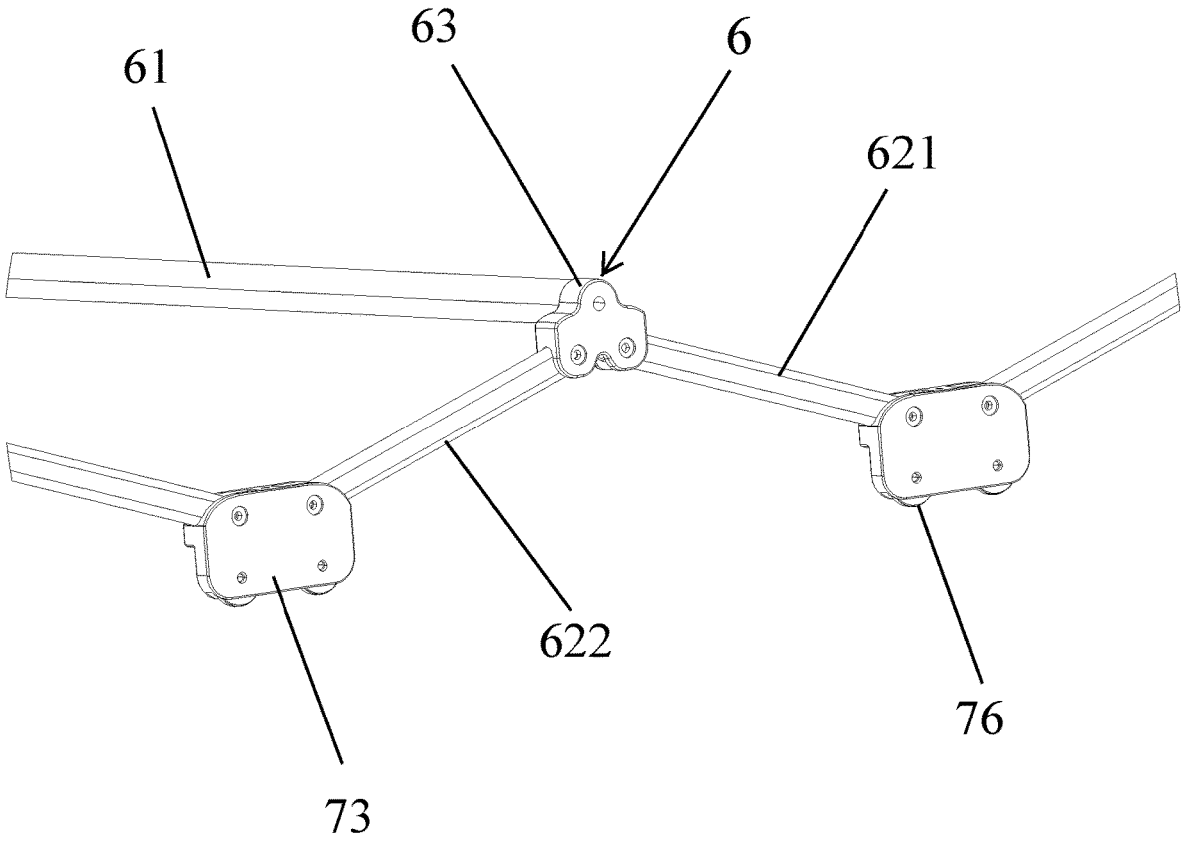
FIG. 9 is a right side perspective view of a folding unit.
Figure 10:
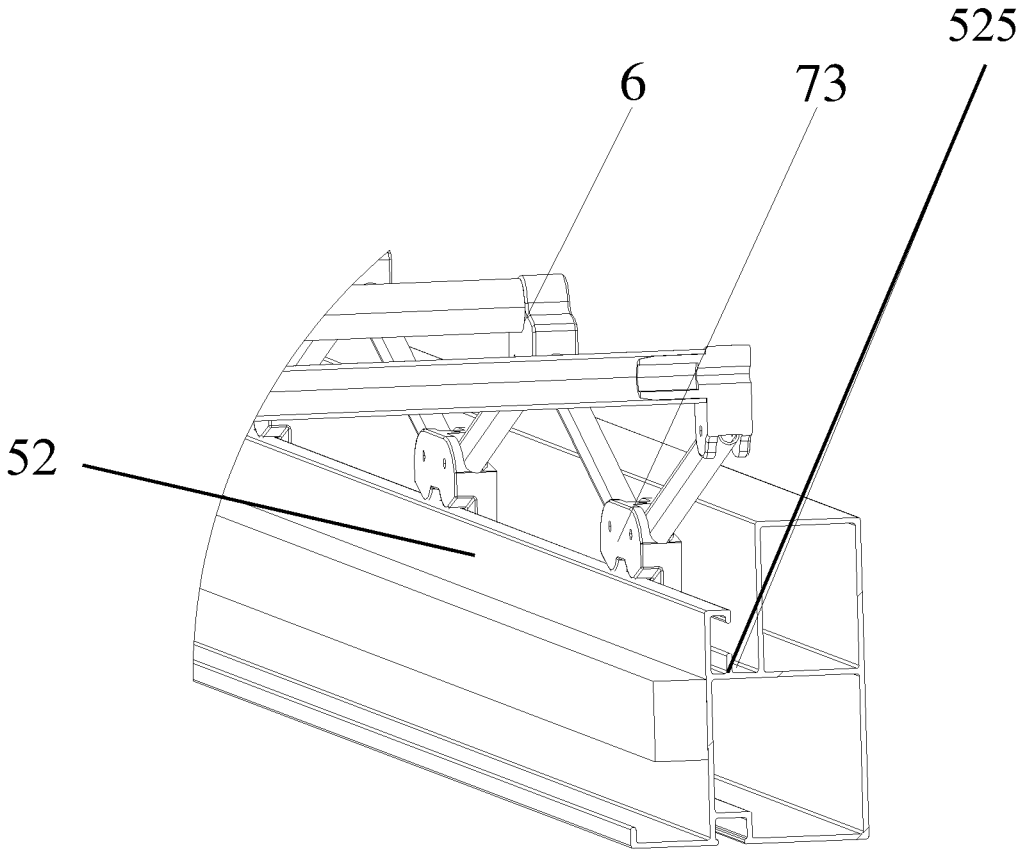
FIG. 10 is a sectional perspective view of a longitudinal ring beam showing a linkage moving wheel seat of the invention.
Figure 11:
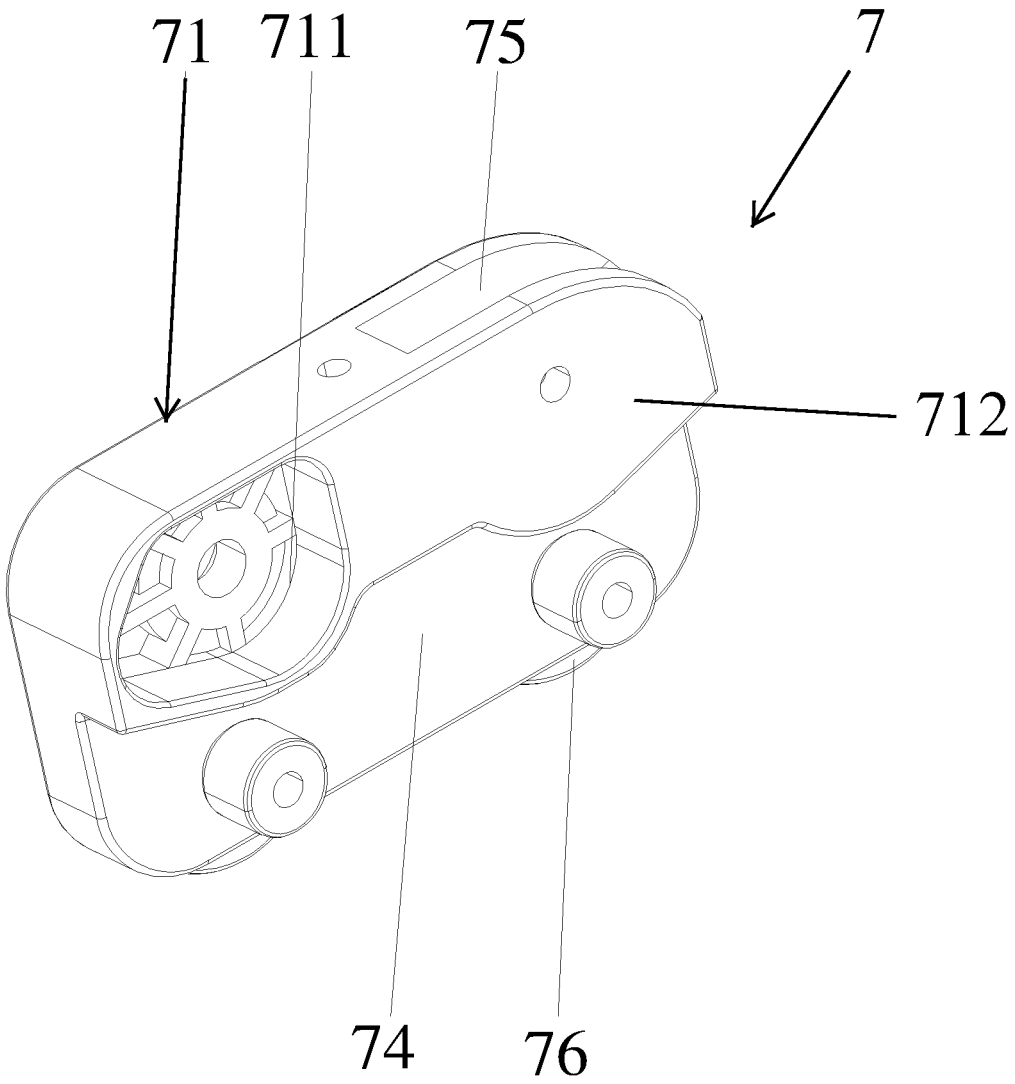
FIG. 11 is a perspective view of the interior face of a movable mobile wheel seat.
Figure 12:
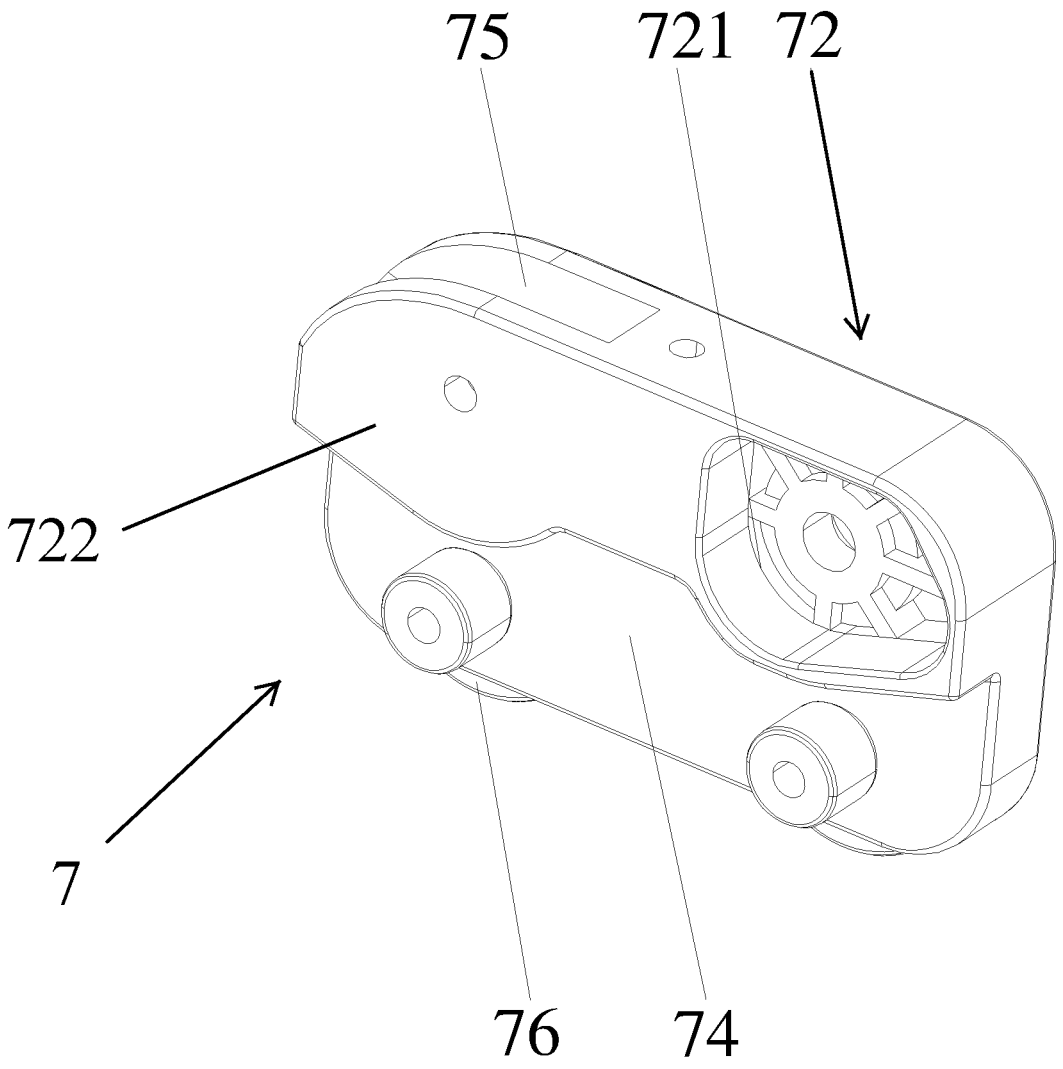
FIG. 12 is a perspective view of the interior face of a fixed mobile wheel seat.
Figure 13:
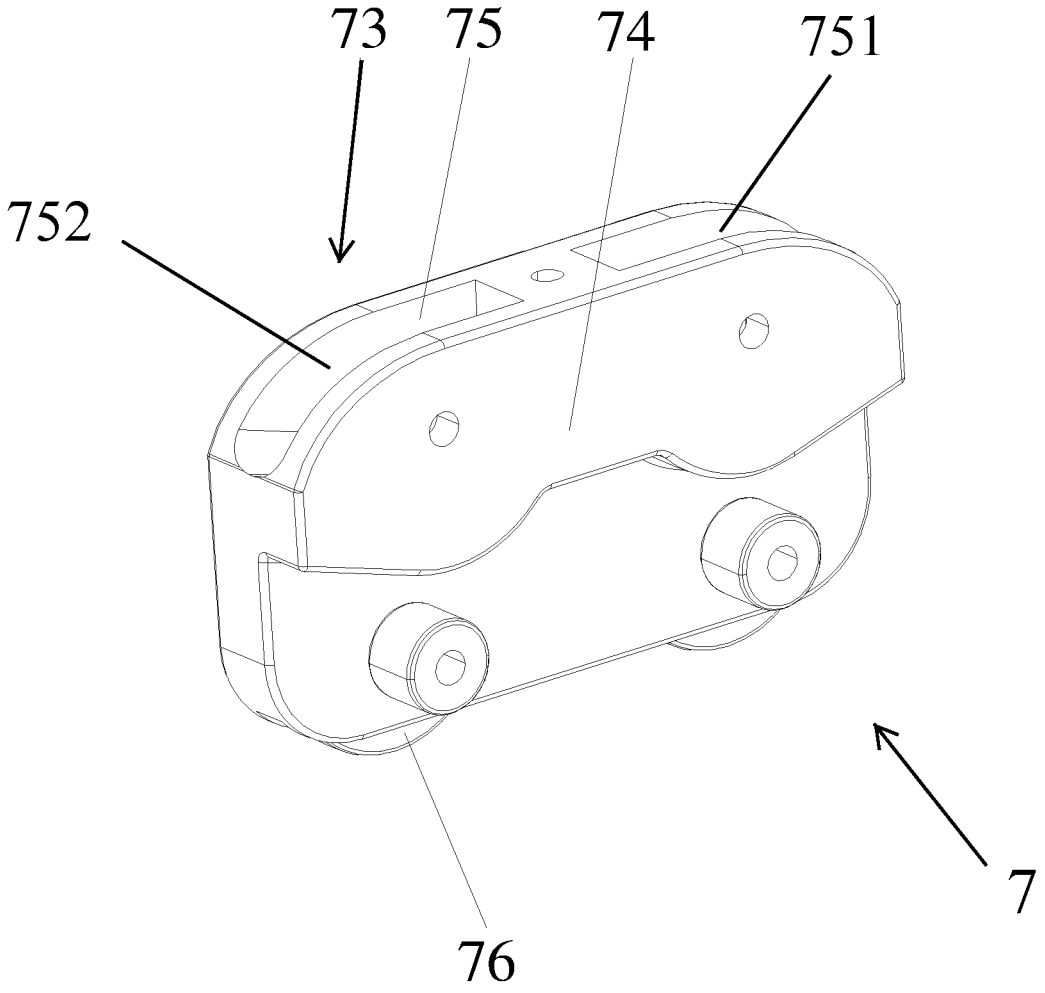
FIG. 13 is a perspective view of the interior face of a linkage movable wheel seat.
Figure 14:
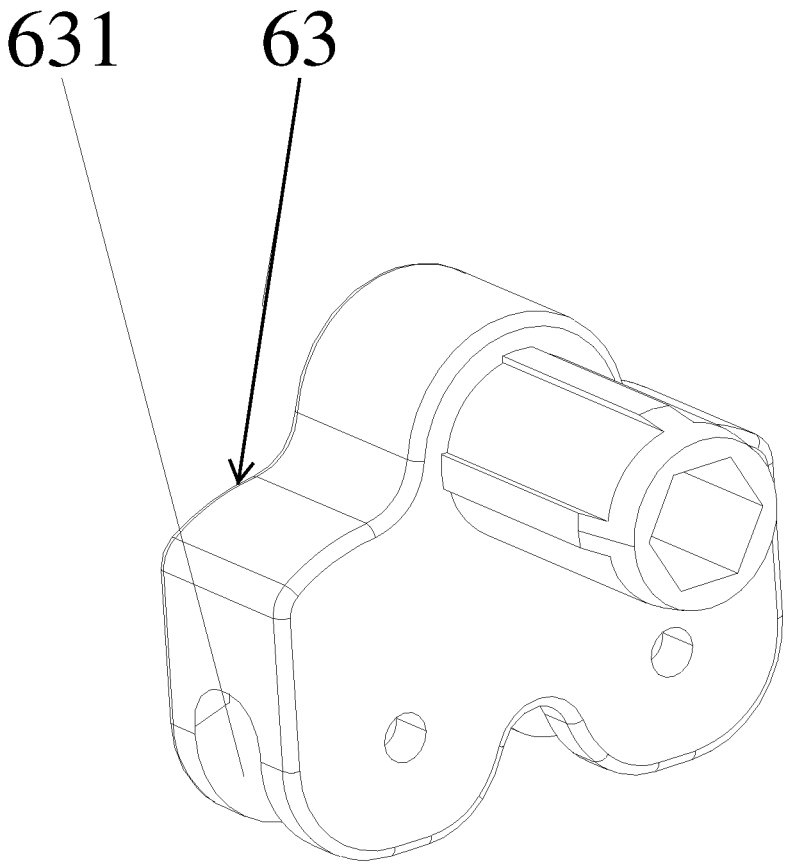
FIG. 14 is a perspective view of the interior face of a hinged seat used in the folding unit.
Figure 15:
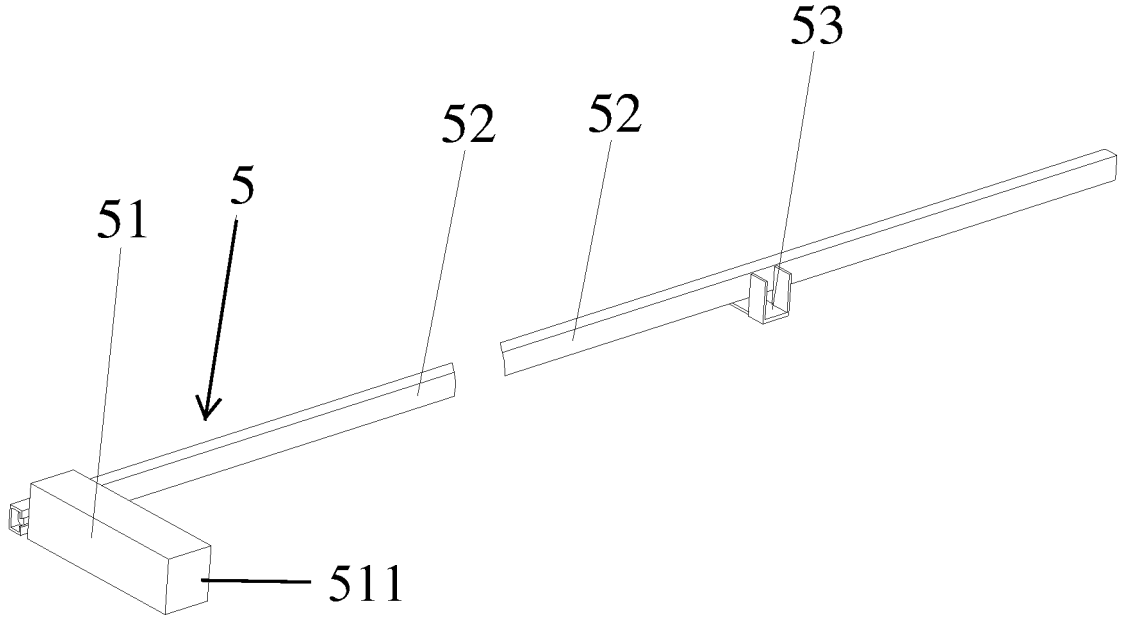
FIG. 15 is a perspective view of the driving component of the present invention.

Preferably, an installation (mounting) groove or receptacle 711 is arranged on the interior face 712 of the right side movable end wheel seat 71, and a second installation groove 711 is arranged on the interior face 712 of the left side movable end wheel seat 71. A mobile connecting rod 64 (shown in FIG. 5), which is located at the movable end of the telescopic assembly 4, is securely installed into the installation grooves 711 of both the right and left side movable end wheel seats 71, thereby connecting them. The mobile connecting rod extends through the sliding seat 53 on each side of the frame 24, thereby operably connecting the mobile connecting rod 64 with the driving component 5 of the tent 10. The sliding seat 53 can be a U-shaped structure having an open upper end, as shown in the illustrated embodiments, or can have a different structure which is capable of being securely connected to the mobile connecting rod 64. In one embodiment, on the proximal end of the frame 24, the fixed mobile wheel seats 72 on the right and left sides are similarly provided with a first mounting groove 721, and the first mounting groove 721 on both sides is used to correspondingly install a connecting rod 65, and the connecting rod 65 is located at the fixed end of the telescopic assembly 4. Thus the proximal side of the tent canopy 3 is used for fitting with the connecting rod, and the distal side is used for fitting with the mobile connecting rod 64.

Preferably, when the telescopic unit 4 is folded, the folding unit 6 is arched upward, and the tent canopy 3 is also arched upward. When the tent canopy 3 is positioned above the folding units 6, the tent canopy 3 can be arched upward to avoid sagging during folding and improve the overall comfort and aesthetic appearance.

Preferably, the driving component 5 comprises a drive assembly 51, a track 52, a drive belt 54 and a sliding seat 53. The drive assembly 51 is used to drive the drive belt 54 to rotate, the track 52 is used to install the drive belt 54, and the sliding seat 53 is installed with the drive belt 54 and can move along the track 52. The driving assembly 5 is a power output component. The sliding seat 53 is used to cooperate with the telescopic unit 4 to realize the folding or extension of the telescopic unit 4.

In one embodiment, the sliding seat 53 is used to cooperate with the movable end wheel seat 71, and the sliding seat 53 is used to drive the movable end wheel seat 71 to move. In this embodiment the sliding seat 53 can be fixedly installed with the movable end wheel seat 71 through the linkage pin shaft or fixed parts, so as to facilitate the overall movement of the movable end wheel seat 71. In one of the embodiments, a mobile connecting rod 64 is provided between the two movable seats 71 at the movable end. The mobile connecting rod 64 is used to cooperate with the sliding base 53, and the sliding base 53 is used to drive the mobile connecting rod 64 to move, so that the mobile connecting rod 64 drives the movable end wheel seat 71 to move, either proximally to retract the tent top or distally to extend the tent top.

When the outdoor tent is in an extended state, the slide seat 53 is in a direction away from (distal to) the drive assembly 51. Generally, the position of the drive assembly 51 is at the fixed end (proximal) position, and the sliding seat 53 moves along the longitudinal ring beam 22 to the fixed end when retracting the tent top, and drives the movable end wheel seat 71 to move toward the fixed end along the sliding groove 525. Thus, the whole movable (distal) end of the telescopic assembly moves to the fixed end and moves with the movable moving wheel seat 71. When the movable end wheel seat 71 contacts the adjacent linkage movable wheel seat 73, the linkage movable wheel seat 73 is also pushed to move toward the fixed end. This linkage movable wheel seat 73 will then contact the proximally located adjacent linkage movable wheel seat 73 and push it toward the proximal end of the tent top, and subsequent linkage movable wheel seats 73 will likewise sequentially come into contact and urge proximally located linkage movable wheel seats 73 in a proximal direction. When the linkage movable wheel seat 73 adjacent to the fixed end wheel seat 72 contacts the fixed end wheel seat 72, the retracting (folding) of the tent top is completed. When the outdoor tent top is being extended, the sliding seat 53 moves in the opposite direction (distally) and drives the movable end wheel seat 71 and/or the connecting rod 64 away from the fixed position at the proximal end until the telescopic assembly is in a fully extended state, thereby extending the roof of the outdoor tent.

In any of the above embodiments, the driving assembly 51 can be a driving motor 511 and a driving gear 512, and the driving motor 511 is used to drive the driving gear 512 to rotate. The driving gear 512 is used to drive the transmission belt (drive belt) 54 to rotate. The driving gear 512 may also be a pulley, which is mainly used to drive the transmission belt 54 to rotate. In the embodiment shown in FIGS. 17 and 18, the driving component 5 can include two gears 512, which are respectively located at the proximal and distal ends of the transmission belt 54, with one driving rotation of the transmission belt 54. In an alternative embodiment, a driving motor can be operably connected to both of the driving gears 512. The driving motor 511 preferably is a servo motor as known in the prior art which can rotate both forward and in reverse. In this embodiment the driving motor 511 is an electric motor, which can be combined with a controller as known in the prior art to realize mobile APP intelligent control, voice control or remote control.

In any of the above embodiments, preferably, the drive assembly 51 includes a transmission worm 513, a transmission gear 514, and a driving gear 512. The transmission worm 513 drives the transmission gear 514 to rotate through rotation. The transmission gear 514 is used to drive the driving gear 512 to rotate, and the driving gear 512 is used to drive the transmission belt 54 to rotate. The driving gear 512 may also be a pulley, which is mainly used to drive the transmission belt 54 to rotate. There are usually two driving gears 512, which are respectively located at both ends of the transmission belt 54, and usually one is driven rotation. The transmission worm can preferably adopt an existing turbine worm structure or a screw rotating structure. The transmission worm can be manually driven by a rocking handle commonly used in the prior art, and the transmission worm rotates to drive the transmission gear to rotate. The transmission gear preferably adopts a sector-shaped toothed disc structure, which is convenient to realize the transmission cooperation with the driving gear. The above structure can also be realized by multi-stage gear transmission. In addition, the transmission worm can also be replaced by a manual drive structure such as a pull rope, the purpose of which is to achieve manual output so that the driving gear can be rotated, thereby driving the transmission belt to achieve rotation.

In the above embodiment, the track 52 and the longitudinal ring beam 22 can be an integral structure. This structure is mainly preferably matched with a manual drive structure, which can reduce the manufacturing cost. Preferably, the transmission gear 514 includes a first transmission tooth gear 5141 and a second transmission tooth gear 5142. The first transmission tooth gear 5141 is mounted on the top end of the transmission worm 513. The teeth of the first transmission tooth gear 5141 and the teeth of the second transmission tooth gear 5142 are meshed, and the teeth of the second transmission tooth gear 5142 rotate synchronously with the driving gear 512 through the connecting shaft 5143.

In addition, preferably, a drive coupling 515 is usually butted between the driving gears 512 located on both longitudinal sides of the tent canopy 3. Generally, the driving gear 512 is the power receiving end, and the middle part of the transmission coupling shaft 515 is connected by a shaft sleeve 516, which is convenient to improve the stability of synchronous transmission.

In any of the above embodiments, the tent body 2 can be, for example, a structure with four leg tubes 23 and a ring beam frame, which is a common outdoor tent with a four-leg structure. The driving assembly 51 can be arranged on one side, although preferably the drive assembly 51 is arranged on both sides, and a controller can be used to realize the synchronous driving of the two drive assemblies 51, resulting in a stable transmission.

In any of the above embodiments, the folding unit 6 can include a canopy pole 61 and hinge seat groups located at two ends of the canopy pole 61. The canopy pole 61 is used to coordinate the installation of the tent canopy 3. The hinge seat groups include a hinge seat 63 and two hinge shafts 62. One end of the two hinge shafts 62 in the same group is hingedly connected with the canopy pole 61, and the other ends are respectively connected with a movable wheel seat 7. The angle change of the hinge shafts 62 in the same group is preferably between 3° and 180°. When the folding unit 6 is folded, the angle formed by the two hinge shafts 62 in the same group gradually decreases. The folding unit 6 is used to cooperate with the movable wheel seat 7. When the adjacent movable wheel seats 7 are in contact, the angle formed by the two hinge shafts 62 in the same group is at the minimum angle. When the adjacent movable wheel seats 7 are in a separated state, the angle formed by the two hinged shafts 62 in the same group gradually increases, until the maximum angle is reached, and the adjacent movable wheel seats 7 achieve their widest longest separation.

Preferably, the movable wheel seat 7 includes a wheel seat body 74 and a movable roller 76 located at the lower part of the wheel seat body 74. The movable rollers 76 are preferably positioned on the interior of the track 52 and support the wheel seats 7. One or two lower hinge grooves 75 are provided on the wheel seat body 74. The lower hinge groove 75 is used to hinge and cooperate with a hinge shaft 62. The end of the canopy pole 61 is hingedly connected to a hinge seat 63. The hinge seat 63 is provided with two upper hinge grooves 631. The upper hinge groove 631 is used for hinged engagement with a hinge shaft 62. It is convenient to cooperate and install the movable wheel seat 7 and the folding unit 6.

By optimizing the design of the telescopic assembly 4, the present invention facilitates the convenient installation of the driving mechanism 5 and realizes folding or extending driving. The folding unit 6 can be used to arch the tent canopy 3 upwards to avoid sagging during folding, and improve the overall comfort and appearance of the tent. The present invention provides an outdoor tent which has a convenient drive installation, low manufacturing cost, and good appearance and customer experience.

Compared with the prior art, the present invention has the following advantages. By optimizing the design of the telescopic assembly, the present invention facilitates the convenient installation of the driving mechanism, and realizes folding or extension driving. The folding unit can be used to arch the tent canopy upward to avoid drooping, thereby improving overall comfort and aesthetic appearance.

The characteristics of the present invention can be clearly understood by referring to the scheme of the present case and the detailed description of the following preferred embodiments. It can be known from common technical knowledge that the present invention can be implemented by other embodiments that do not depart from its spirit or essential features. Therefore, the above-disclosed embodiments are only illustrative in all aspects, and not the only ones. All changes within the scope of the present invention or within the scope equivalent to the present invention are encompassed by the present invention.

The examples set forth herein are provided to illustrate certain concepts of the disclosure. The apparatus, devices, or components illustrated above may be configured to perform one or more of the methods, features, or steps described herein. Those of ordinary skill in the art will comprehend that these are merely illustrative in nature, and other examples may fall within the scope of the disclosure and the appended claims. Based on the teachings herein those skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein. The various features and processes described above may be used independently of one another, or may be combined in various ways. All possible combinations and sub-combinations are intended to fall within the scope of this disclosure. In addition, certain steps or features may be omitted in some implementations. All patents, patent publications, and other publications referred to herein are incorporated by reference in their entireties.

What is claimed is:

1. An outdoor tent, comprising:

1) a tent body, wherein the tent body comprises a rectangular ring beam frame, the ring beam frame comprising at least a distal transverse ring beam, a right side longitudinal ring beam, a left side longitudinal ring beam, a right side track, a left side track, and at least two legs extending downwardly from the ring beam frame, wherein the right side track is secured to the right side longitudinal ring beam and the left side track is secured to the left side longitudinal ring beam;

2) a tent top comprising a canopy and a telescopic assembly beneath the canopy, the telescopic assembly comprising:

2.1) a right side telescopic component and a left side telescopic component, wherein each of the right side and left side telescopic components comprises:

2.1.1) a plurality of folding units, each folding unit comprising a hinge seat, a proximal hinge shaft, and a distal hinge shaft, wherein the hinge seat is hingedly connected on a proximal side to the proximal hinge shaft and is hingedly connected on a distal side to the distal hinge shaft; and 2.1.2) a plurality of wheel seats, each wheel seat comprising at least one hinge groove hingedly connected to the proximal hinge shaft or the distal hinge shaft of a folding unit, wherein the plurality of wheel seats comprise a fixed end wheel seat on a proximal end of the track which remains fixed in place and is hingedly connected to a proximal hinge shaft of an adjacent folding unit, a movable end wheel seat on a distal end of the track which is hingedly connected to a distal hinge shaft of an adjacent folding unit, and a plurality of linkage movable wheel seats between the fixed end wheel seat and the movable end wheel seat, wherein each linkage movable wheel seat is hingedly connected on a proximal end to the distal hinge shaft of a proximally positioned adjacent folding unit and is hingedly connected on a distal end to the proximal hinge shaft of a distally positioned adjacent folding unit;

2.2) a plurality of canopy poles, wherein each hinge seat of the right side telescopic component is mechanically connected to a hinge seat of the left side telescopic component by a canopy pole extending between the right side telescopic component and the left side telescopic component;

2.3) a connecting rod secured to and extending between the right side movable end wheel seat and the left side movable end wheel seat; and 3) a driving component comprising:

3.1) a drive belt extending longitudinally on an interior of at least one of the right side track or the left side track;

3.2) a drive assembly for moving the drive belt; and 3.3) a sliding seat operably connected to the drive belt and to the movable end wheel seat, wherein the drive assembly is operable to rotate the drive belt, wherein rotation of the drive belt moves the sliding seat, and wherein movement of the sliding seat operates to move the telescopic assembly and canopy, thereby extending or retracting the canopy along the longitudinal ring beams.

2. The outdoor tent of claim 1, wherein the tent comprises at least three legs extending downwardly from the ring beam frame.

3. The outdoor tent of claim 1, wherein four legs extend downwardly from the ring beam frame, so that a leg extends downwardly from each corner of the rectangular ring beam frame.

4. The outdoor tent of claim 1, wherein the sliding seat is fixedly installed with the movable end wheel seat.

5. The outdoor tent of claim 1, wherein the sliding seat is secured to the connecting rod.

6. The outdoor tent of claim 1, further comprising a proximal transverse ring beam having a right side and a left side, wherein the right side of the proximal transverse ring beam is attached to a proximal end of the right side longitudinal ring beam and the left side of the proximal transverse ring beam is attached to a proximal end of the left side longitudinal ring beam.

7. The outdoor tent of claim 1, wherein the driving component is manually driven.

8. The outdoor tent of claim 1, wherein the drive assembly comprises a drive motor.

9. The outdoor tent of claim 8, wherein the drive motor rotates a driving gear and the driving gear rotates the drive belt.

10. The outdoor tent of claim 9, wherein a drive worm rotates a transmission gear and the transmission gear rotates the driving gear.

* * * * *